United States Patent [19]

Justice et al.

[11] 4,298,828

[45] Nov. 3, 1981

[54] HIGH FREQUENCY ELECTRODELESS LAMP HAVING A GAPPED MAGNETIC CORE AND METHOD

[75] Inventors: James W. H. Justice, Murrysville; Martin D. Nahemow, Pittsburgh, both of Pa.

[73] Assignee: Westinghouse Electric Corp., Pittsburgh, Pa.

[21] Appl. No.: 64,935

[22] Filed: Aug. 8, 1979

Related U.S. Application Data

[63] Continuation-in-part of Ser. No. 13,594, Feb. 21, 1979, abandoned, which is a continuation-in-part of Ser. No. 883,544, Mar. 6, 1978, abandoned.

[51] Int. Cl.[3] ..... H05B 41/16; H05B 41/24

[52] U.S. Cl. ..... 315/248; 315/39; 315/57; 315/344; 336/212; 336/216

[58] Field of Search ..... 315/39, 248, 344, 267, 315/57; 336/212, 216, 219

[56] References Cited

U.S. PATENT DOCUMENTS

| | | | |
|---|---|---|---|
| 1,813,580 | 7/1931 | Morrison | 315/248 X |
| 3,611,191 | 10/1971 | Altman et al. | 315/344 |
| 3,884,583 | 5/1975 | Kikuchi | 336/85 |
| 3,987,335 | 10/1976 | Anders on | 315/248 |
| 4,048,604 | 9/1977 | Vallet | 336/212 |
| 4,070,602 | 1/1978 | Ferro et al. | 315/248 |

*Primary Examiner*—Saxfield Chatmon, Jr.
*Attorney, Agent, or Firm*—W. D. Palmer

[57] ABSTRACT

High frequency electrodeless (HFE) lamp has high-permeability core such as ferrite positioned in energy transferring relationship with respect to the phosphor-coated lamp envelope. The core forms a part of a tuned circuit output for a radio-frequency energizing source and during lamp operation, the resulting electromagnetic fields generated within the lamp envelope create a discharge which in turn generates radiations to excite the phosphor to produce visible light. The core is specially designed to include narrow gap means of low-permeability substance and this gap improves lamp performance by providing the dual function of stabilizing the output frequency of the tuned circuit to compensate for variations in permeability of the core and, in addition, the resulting increased Q of the tuned circuit substantially suppresses harmonics of the resonant frequency which are undesirable in such a lamp. There is also provided a method for assembling such a lamp as well as the finished lamp wherein the phosphor-coated envelope can be processed and sealed, and thereafter the core is assembled therewith so that the core is not subject to the temperature extremes required for proper envelope processing.

29 Claims, 19 Drawing Figures

HIGH FREQUENCY ELECTRODELESS LAMP HAVING A GAPPED MAGNETIC CORE AND METHOD

CROSS-REFERENCE TO RELATED APPLICATION

This application is a continuation-in-part of application Ser. No. 13,594, filed Feb. 21, 1979, now abandoned, which in turn is a continuation-in-part of application Ser. No. 883,544, filed Mar. 6, 1978, now abandoned, both filed by the present applicants and owned by the present assignee.

In copending application Ser. No. 13,703, filed Feb. 21, 1979 by James W. H. Justice, one of the present applicants, and owned by the present assignee, now U.S. Pat. No. 4,245,178 dated Jan. 13, 1981, is disclosed an improved circuit for energizing the present lamps wherein a simplified oscillator is operated in Class E mode.

BACKGROUND OF THE INVENTION

This invention generally relates to high frequency electrodeless lamps and, more particularly, to such lamps which are specially designed to have a relatively constant predetermined operating frequency with a minimum of output harmonics of the operating frequency.

High frequency electrodeless (HFE) lamps have received considerable attention in recent years as a possible replacement for the standard household incandescent lamps which convert electricity into light in a relatively inefficient manner. Fluorescent lamps are efficient converters of electricity into light, but their cumbersome size and their need for ballasting has limited their application in the household. HFE lamps, in contrast to the standard fluorescent lamps, can be fabricated in a relatively compact size.

U.S. Pat. No. 4,017,764, date Apr. 12, 1977 to Anderson, discloses an HFE lamp of the fluorescent type wherein a ferrite core is entirely contained within a phosphor-coated envelope. At column 5, lines 38–43 thereof, it is suggested to admix with powdered ferrite a polyimide resin to lower the permeability of the core.

U.S. Pat. No. 4,010,400, dated Mar. 1, 1977 to Hollister, discloses an HFE lamp which utilizes a ferrite core as a part of a tuned circuit output for a radio frequency energizing source.

U.S. Pat. No. 4,005,330 dated Jan. 25, 1977 to Glascock et al. discloses an HFE lamp wherein a closed magnetic core is positioned exteriorly of the environment of the envelope, but in energy transferring relationship with respect to the environment within the envelope.

U.S. Pat. No. 3,987,335, dated Oct. 19, 1976 to Anderson, discloses an HFE lamp of the fluorescent type wherein a ferrite core is only partially contained within the phosphor coated envelope.

U.S. Pat. No. 3,908,264, date Sep. 30, 1975 to Frieberg et al., discloses a high permeability core which constitutes a part of a tuned circuit wherein the resonant frequency of the circuit is calibrated by removing a portion of the core.

U.S. Pat. No. 3,150,340, dated Sep. 22, 1964 to Kalbfell, discloses a toroidal core for a high Q coil which includes an air gap in order to obtain a high value of Q for the coil.

An early design of electrodeless discharge lamp wherein the discharge is maintained by the fields established by a magnetic coil is disclosed in U.S. Pat. No. 1,813,580, dated Jul. 7, 1931 to Morrison.

SUMMARY OF THE INVENTION

There is provided an electrodeless discharge device designed to operate with a rated power consumption when energized with predetermined radio frequency energy as generated by a radio frequency power source. The power source has an output portion comprising a tuned circuit having a resonant frequency which approximates the predetermined radio frequency at which the device is to be operated. The device comprises a sealed, light-transmitting envelope of predetermined dimensions, preferably of rounded or globular shape, and containing a discharge-sustaining medium with a layer comprising phosphor carried on the envelope interior surface. A magnetic core such as ferrite is operatively positioned in energy transferring relationship with respect to the environment within the envelope and the ferrite material which principally comprises the core has a very high permeability. The core has a generally looped configuration, and in accordance with the present invention, the basic core is interrupted to include narrow gap means comprising low-permeability substance which traverses the cross section of the core. A winding having a predetermined number of turns is wrapped about the core and the winding is connected to a radio frequency power source by means of lead-in members. The core comprises a part of the tuned circuit output portion of the radio frequency power source and the magnetic permeability of the core constitutes a principal variable factor which can cause the resonant frequency of the tuned circuit output portion to vary. During operation of the device, the gap means in the core stabilizes the effective permeability of the core so that substantial changes in the permeability of the principal material comprising the core reflect only as minor changes in the overall effective permeability of the gapped core. This stabilizes the operating resonant frequency of the tuned circuit output portion and the gap means in the core also substantially increases the Q of the tuned circuit, as compared to the Q of an otherwise similar tuned circuit which does not utilize a gap, in order to substantially increase the selectivity of the tuned circuit output portion and suppress output harmonics of the resonant frequency.

There is also provided a method for fabricating such devices as well as the resulting devices wherein the core portions thereof are not exposed to the temperature extremes required for processing the envelopes.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
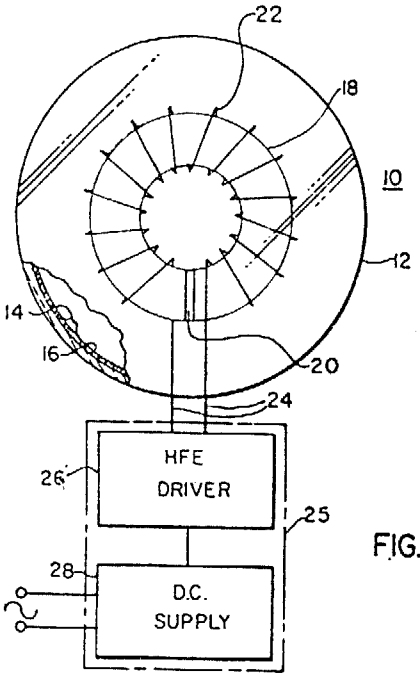
FIG. 1 is a diagrammatic view, shown partly in section, of the basic components comprising the present lamp.

Referring to the diagrammatic showing of FIG. 1, the lamp 10 generally comprises a sealed light-transmitting globular-shaped envelope 12 of predetermined dimensions and enclosing a discharge-sustaining medium such as a few torrs of argon and a small amount of mercury 14, similar to conventional fluorescent lamps. Carried on the internal surface of the envelope is a layer 16 comprising luminescent phosphor material. Included within the envelope is a core 18 which principally comprises magnetic material of high permeability and having a looped configuration of predetermined dimensions. As a specific example, the core has a toroidal configuration and in accordance with the present invention, it also includes a narrow gap 20 comprising low-permeability substance such as mica traversing the cross section of the core. A winding 22 having a predetermined number of turns is wrapped about the core and lead-in members 24 connect the winding 22 to the radio frequency power source 25 which comprises an HF drive and oscillator section 26 together with an A.C. to D.C. power supply 28 designed to operate from a standard 115 volt A.C., 60 Hz line. In the operation of the lamp as shown in FIG. 1, when the lamp is energized, the radio frequency electromagnetic fields set up through and about the core and within the envelope excite the discharge-sustaining medium to emit short wavelength radiations which in turn excite the phosphor layer to emit visible radiations which pass through the envelope.

Figure 2A:
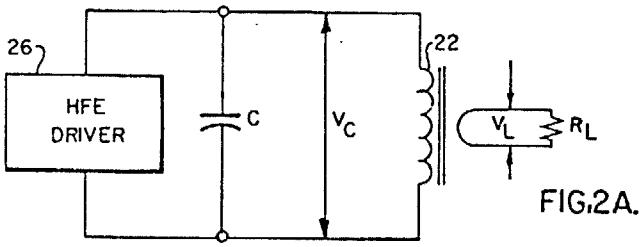
FIG. 2A is a simplified circuit diagram for the present HFE lamp and the circuit shown in FIG. 2B is equivalent to that shown in FIG. 2A.
Figure 2B:
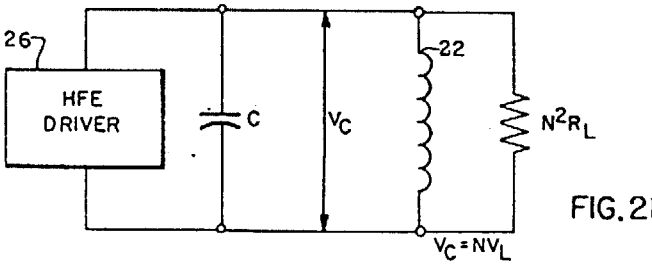

The ferrite core can be considered, electrically, as a transformer with "N" turns of winding 22 on its primary and one turn on its secondary, namely the discharge, loaded by the equivalent lamp resistance, $R_L$. FIG. 2A shows this equivalent circuit with the lamp voltage, $V_L$, also indicated and FIG. 2B shows a further simplification of this equivalent circuit. In operation, lamp load is reflected in the coil 22 as approximately $N^2R_L$ ohms.

Figure 4:
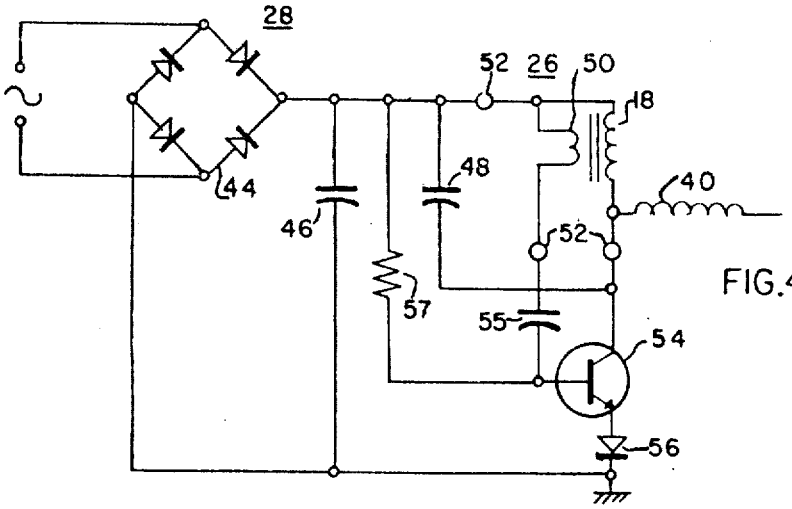
FIG. 4 is a detailed diagram of an A.C. to D.C. power supply together with the high frequency driver and oscillator used to energize the lamp shown in FIG. 3.
Figure 6:
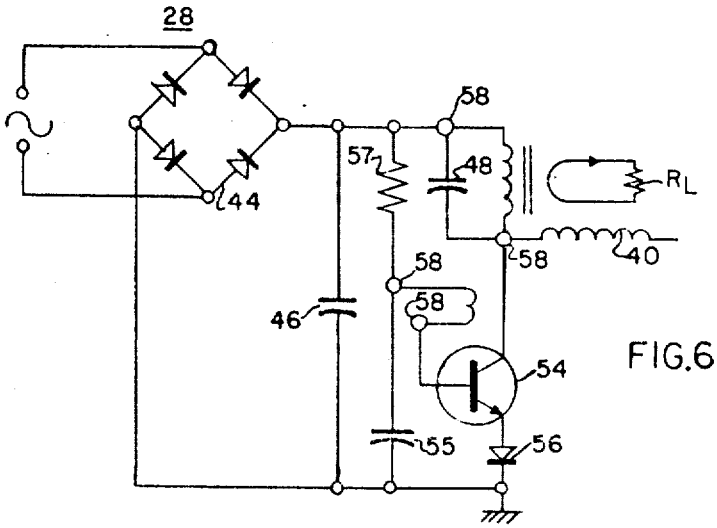
FIG. 6 is an alternative circuit diagram for the A.C. to D.C. power supply together with the high frequency driver and oscillator for energizing the lamp embodiment as shown in FIG. 5.

In FIGS. 4 and 6 are shown two of many possible circuit configurations suitable for driving an HFE lamp. The circuits are self-oscillatory and operate in a class A, B or C mode, with class B or C providing both good efficiency and power output. The frequency of operation of these circuits is determined by the inductance, L, and the capacitance, C, values of the tank circuits. An improved circuit is shown in the cross-referenced copending application Ser. No. 13,703, filed Feb. 21, 1979, now Pat. No. 4,245,178, wherein the circuit can be made very compact and operates with excellent efficiency in Class E Mode.

For a given lamp-core-gas configuration and composition, the operating voltage of the lamp, $V_L$, is fixed within fairly close limits. Under class B or C operation, the RMS voltage $V_C$ across the primary winding for specific lamps as considered hereinafter will be approximately 0.707 $V_{DC}$ or in this case, 113 $V_{RMS}$. The number of turns of the primary winding 22 on the ferrite core will be $N = V_C/V_L = 0.707\ V_{DC}/V_L$.

EFFECTS OF CHANGES IN PERMEABILITY OF THE CORE

Temperature variations in the operating lamp and also manufacturing variations in the fabrication of the ferrite cores can cause the permeability of the core to vary. With reference to the equivalent circuit as shown in FIG. 2B, the resonant frequency, fo, of the circuit is given by:

$$fo = \frac{1}{2\pi\sqrt{LC}} \text{ Hz} \quad \text{(I)}$$

where L is the inductance of the coil 22 in Henries and C is the tank capacitance in Farads. L can be determined as follows:

$$L_{Coil} = \frac{4\pi N^2 \mu' A_C}{10^9 l_C} \text{ Henries.} \quad \text{(II)}$$

where N is the number of turns, $\mu'$ is the effective permeability, $A_C$ is the cross sectional area of the core in square centimeters and $1_C$ is the length of the magnetic path in the core in centimeters.

In order to determine the effects of changes in permeability of the principal material comprising the core, the permeability of the core formed as a completely closed loop of ferrite can be defined as $\mu_C$. If there is introduced into the core a narrow gap comprising low permeability, $\mu_A$, substance such as mica, which traverses the cross section of the core, the effective permeability of the core changes to $\mu'$ where $\mu_C$ and $\mu'$ are related as follows:

$$\mu' = \frac{\mu_C}{1 + \frac{\mu_C l_A}{\mu_A l_C}} \quad \text{(III)}$$

Considering a practical case, for a commercial ferrite core having a torroidal configuration with an outer diameter of 6.096 centimeters, an inner diameter of 3.556 centimeters and a thickness of 1.27 centimeters, a representative value of permeability for the ferrite, $\mu_C$, is 5,000, the effective cross sectional diameter area, $A_C$, is 1.57 sq cm, and the mean core length, $1_C$, is 14.43 cm. When a mica gap, for which $\mu_A=1$, having a thickness of 0.015 cm is included in the core, the effective permeability of the core is decreased from 5,000 to 806.8 as determined by substituting the foregoing values into the permeability formula (III).

Consider the effects of a 20% change or decrease in actual permeability of the principal material comprising the core, i.e., the ferrite, upon the effective permeability of a gapped core. If the actual permeability of the ferrite decreases 20%, i.e., from 5,000 to 4,000, by substituting the modified values into the foregoing effective permeability formula (III), it is seen that the effective permeability for the gapped core will be 775.5. From the foregoing, it can be seen that a 20% change in the actual permeability of the ferrite material introduces a change in $\mu'$, namely the effective permeability of the core, of only 3.9%. Thus by including the narrow gap in the core, changes in the permeability of the ferrite material due to manufacturing variability, or temperature, or both, will have very much less effect upon the actual or effective permeability of the gapped core.

EFFECTS OF STABILIZED PERMEABILITY OF CORE ON RESONANT FREQUENCY OF TUNED CIRCUIT

As indicated hereinbefore, the core comprises a part of the tuned circuit output portion of the radio frequency power source, with the resonant frequency being determined in accordance with the previously recited formula. For a core having 22 turns wrapped thereabout and an effective permeability of 806.8, the core inductance can be calculated as 534 microhenries. A representative value of a capacitance used with the tuned circuit is 5,000 picofarads, which provide a resonant frequency for the tuned circuit of 97.4 kilohertz, see formula (I). As a matter of practicality, for good power transfer to the discharge with only limited electrical losses in the core, this is a very desirable operating frequency. Using the foregoing example wherein the effective permeability of the gapped core is decreased to 775.5, the effect upon the resonant frequency will be to increase same by 1.99%. If the gap were not included in the core, however, a 20% decrease in the permeability of the core would increase the resonant frequency of the tuned circuit by over 10%. From the foregoing, it can be seen that inclusion of the gap in the core stabilizes the resonant frequency of the tuned circuit of which the core is a part and from a practical lamp design standpoint, this is highly desirable.

It should be understood that the predetermined frequency at which the lamp is adapted to be operated can vary considerably within the low frequency radio frequency range and, as a practical matter, operating frequencies in the order of 70 to 110 kilohertz have been found to be very acceptable from the standpoint of minimized core losses and radiation levels.

EFFECT OF GAPPED CORE IN SUPPRESSING OUTPUT HARMONICS OF RESONANT FREQUENCY

The inductance, $L_C$, for a core and coil without a gap is determined by the foregoing formula (II), repeated as follows:

$$L_C = \frac{4\pi N^2 \mu_C A_C}{10^9 l_C} \text{ Henries,} \quad \text{(II)}$$

wherein the number of turns is 22, $\mu_C=5{,}000$, $A_C=1.57$, and $1_C=14.43$. Under these conditions, $L_C=3309$ microhenries.

If an air gap is included, as before, wherein the effective permeability of the gapped core is 806.8, the resulting inductance, $L_A$, of the gapped core and coil can be calculated as 534 microhenries, using formula (II).

Referring now to the equivalent circuit as shown in FIG. 2B, the effective Q for the tuned circuit is given by the following formula:

$$Q = \frac{N^2 R_L}{\omega L} \quad \text{(IV)}$$

For a 40 watt lamp, a representative value of $V_l$ is 5 volts and $R_L$ is 0.625 ohm. Substituting the values of $L_C=3309$ michrohenries and $L_A=534$ microhenries into the foregoing formula, the Q of the circuit without the air gap is 0.149 and with the air gap the Q is approximately 0.93.

With a lower value of Q, the selectivity of the tuned circuit against harmonics is quite poor whereas if Q approximates a value of about 1, the selectivity is much improved, as shown in the following Table A:

TABLE A

| Q | f = fo | f = 2fo | f = 3fo | f = 4fo |
|---|---|---|---|---|
| .162 | 0 dB | −.24 dB | −.716 dB | −1.32 dB |
| .5 | 0 dB | −1.9 dB | −4.4 dB | −6.55 dB |
| 1.0 | 0 dB | −5.1 dB | −8.9 dB | −11.77 dB |
| 2 | 0 dB | −10 dB | −4.65 dB | −17.6 dB |
| 3 | 0 dB | −13 dB | −18.13 dB | −21 dB |

The efficiency of the output circuit can be defined in terms of the Q of the circuit with the load removed, $Q_U$, and the Q with the load applied, $Q_L$, as follows:

$$n = \left(1 - \frac{Q_L}{Q_U}\right) \times 100\% \quad \text{(V)}$$

For a practical case, $Q_U$ approximates 20, and the following Table B can be made:

TABLE B

| $Q_L$ | n |
|---|---|
| .162 | 99.2% |
| .5 | 97.5% |
| 1 | 95 |
| 2 | 90 |
| 4 | 80 |

As can be seen from the foregoing Table B, for a value of $Q_L$ in the order of about 1, there is about a 5% loss in efficiency, but selectivity is substantially improved over those coils having a substantially lower $Q_L$. Since it is highly desirable to minimize harmonics while maintaining the efficiency relatively high, it is also desirable to obtain values of Q for the tuned circuit in the order of about 1.

PRACTICAL LAMP EMBODIMENTS

Figure 3:
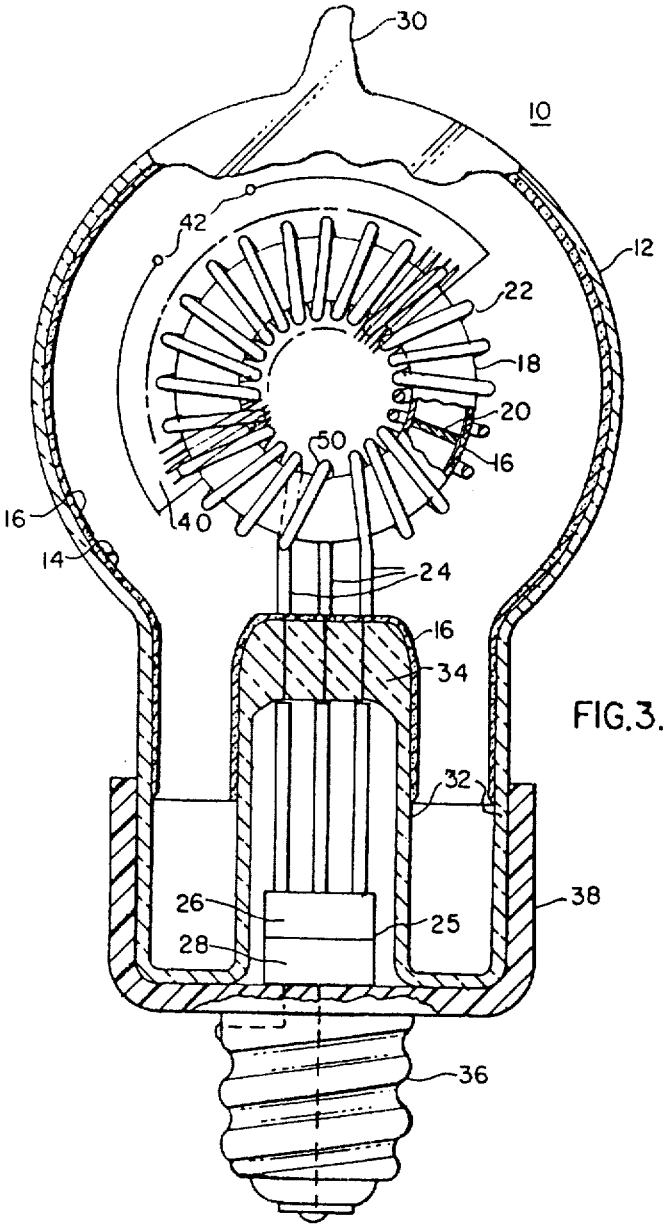
FIG. 3 is an elevational view, shown partly in section, of a practical embodiment of an HFE lamp, wherein the gapped core is entirely contained with the lamp envelope.

Referring to FIG. 3, the lamp 10 comprises a sealed light-transmitting globular or pear-shaped envelope 12 of predetermined dimensions. As an example, the envelope 12 has a height of 6 inches and an outer diameter of 4 inches. The envelope 12 is evacuated via the tip 30 at the top thereof and is provided with a discharge-sustaining filling comprising 1.5 torrs of argon and a small charge of mercury 14 or a mercury amalgam. A layer comprising phosphor material 16 is carried on the interior surface of the envelope and as a specific example, any of the standard halophosphates can be used. Alternatively, for better temperature-dependence characteristics, a three component blend of rare-earth activated phosphors can be used and such a phosphor mixture is disclosed in U.S. Pat. No. 3,937,998, dated Feb. 10, 1976 to Verstegen et al.

A core 18, such as previously described in detail, is operatively positioned within the envelope 12 and the core principally comprises magnetic material of high permeability and having a looped configuration of predetermined dimensions and a cross sectional area, such as previously described in detail. Preferably the core has a toroidal configuration for convenience of manufacturing, but his configuration can be varied considerably. As described hereinbefore, the core also includes a narrow gap 20 which traverses the cross section of the core and a winding 22 of twenty-two turns is wrapped about the core 18.

The preferred principal material comprising the core 18 is ferrite, although other magnetic materials can be substituted therefor. As is well known, and using a dictionary definition, ferrite is any of several compounds formed usually by treating hydrated ferric oxide with an alkali or by heating ferric oxide with a metallic oxide and regarded in some cases as spinels such as $NaFeO_2$ or $ZnFe_2O_4$. The ferrite core specifically considered hereinbefore is marketed as the 8000 Series by Indiana General, a Division of Electronic Memories & Magnetics Corp., Keasbey, NJ and is commercially available in a form which is not provided with the gap as described hereinbefore. Such ferrites are normally prepared with a sintering technique. As sintered in a torroidal form, the ferrite has a high permeability such as 5,000 and a low electrical resistivity such as 100 ohm-cm.

Lead-in members 24 connect the winding 22 to the radio frequency power source 25 comprising the combined driver 26 and A.C. to D.C. power supply 28 (shown in block form in FIG. 1) and positioned within the elongated neck portion 32 of the lamp 10. As previously described, the core 18 comprises a part of the tuned circuit output portion for the radio frequency power source and the magnetic permeability of the core constitutes a principal variable factor which can cause this resonant frequency of the tuned circuit output portion to vary. Other details of the lamp 10 are of generally conventional construction and three leads to the coil 18 are sealed through a stem 34 to connect to the power source 25 within the elongated stem and neck, which in turn connects to a conventional screw type base 36 which is affixed to the lamp neck by means of a base adaptor member 38 formed of suitable plastic such as phenolic resin. Preferably, the phosphor material is also coated over the core 18 for most efficient utilization of the 254 nm radiations generated by the low-pressure mercury discharge. Alternatively, a reflecting coating can be provided over the core and the phosphor layer 16 applied thereover.

The operation of the lamp 10 is initiated by means of an additional winding 40 comprising a relatively large number of turns carried on the core 18 and the winding 40 terminates in end portions 42 spaced apart a predetermined distance within the envelope 12. In the operation of the device, when the tuned circuit is initially energized, the additional winding 40 has generated between the spaced end portions 42 a relatively high voltage and the capacitive coupling therebetween ionizes the discharge-sustaining medium within the envelope 12 to initiate the operation of the device. Once the device is operating, the winding 40 in effect is out of the circuit. As a specific example, the winding 40 comprises eighty-eight turns and the end portions 42 are spaced apart by more than one centimeter, and example being two cm.

In FIG. 4 is shown the circuit which is used to energize the lamp embodiment as shown in FIG. 3 and the circuit comprises the A.C. to D.C. power supply section 28 comprising a full wave diode rectifier 44 and filter capacitor 46 and the HF driver and oscillator section 26 comprising the core section 18, tuned circuit capacitor 48, and feedback coil 50 which comprises one or two turns carried on the core 18. The additional starting winding 40 is shown as connected to one of the leads, although it need not be. The three terminal connections at the lamp stem 34 are shown as 52. To complete the circuit, a transistor 54, capacitor 55 and blocking diode 56 provide the necessary oscillation. The capacitor 55 and resistor 57 provide proper bias for the transistor 54. In the circuit shown in FIG. 4, 160 volts D.C. are developed by the full wave rectifier. With a turns ratio of 22:1, this provides 5 volts A.C. drop across the operating discharge and with a load resistance of 0.625 ohm, the lamp operates with a wattage consumption in the discharge of 40 watts. With this type of lamp and using a cool white halophosphate phosphor, representative efficacies of sixty lumens per watt have been obtained with an additional loss of seventeen watts in the power source. Substantially higher efficacies are contemplated by the use of rare-earth activated phosphors.

Figure 5:
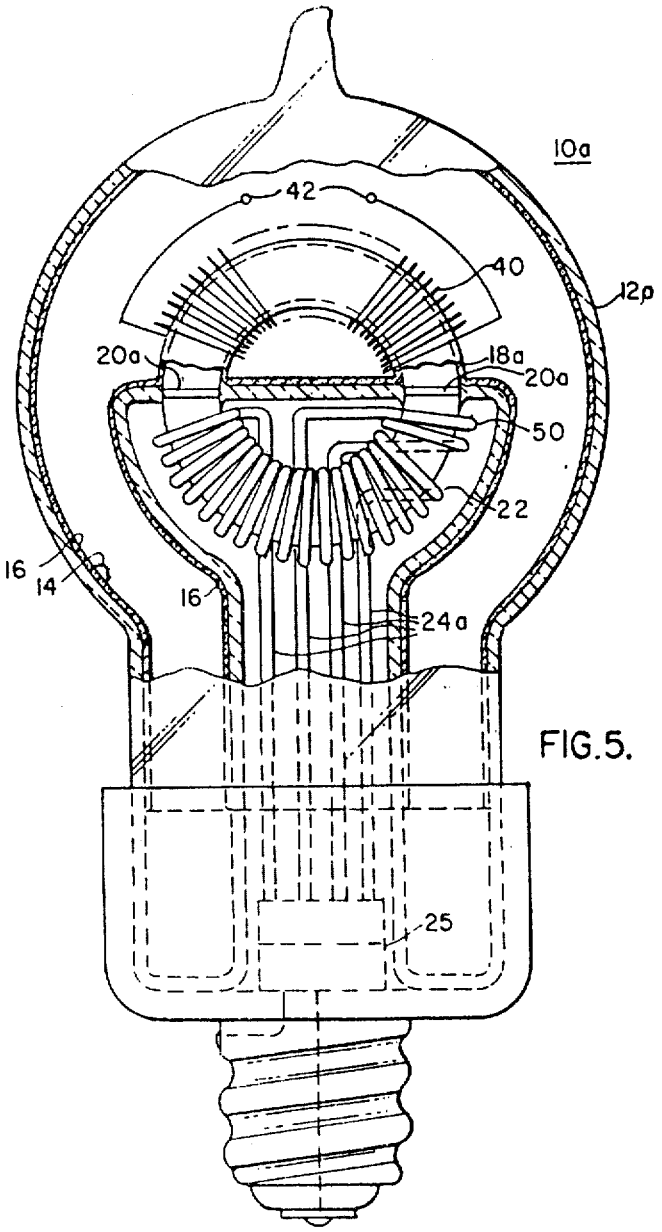
FIG. 5 is an elevational view, shown partly in section, of an alternative lamp embodiment wherein the gapped ferrite core is only partially contained within the lamp envelope.

An alternative lamp embodiment 10*a* is disclosed in FIG. 5 wherein only a portion of the core 18*a* is contained within the envelope 12*a*. The twenty-two turns of the winding 22 are wrapped about that portion of the core 18*a* which is positioned exteriorly of the sealed envelope 12*a*. The eighty-eight turns of the starting winding 40, however, have the end portions 42 thereof positioned within the envelope to initiate the discharge. In this embodiment, four leads 24*a* connect the RF power source 25 to the main winding 22 and feedback coil 50. A circuit for energizing the lamp embodiment of FIG. 5 is shown in FIG. 6 and the terminal connections between the coils 22 and 50 and the power source are indicated as 58. The circuit is otherwise the same as shown in FIG. 4. In this lamp embodiment, the gap means are provided as two individual gaps 20*a*, each having a thickness of 0.0075 cm. and they are positioned at those portions of the core 18*a* which pass through the envelope 12*a*.

Figure 7:
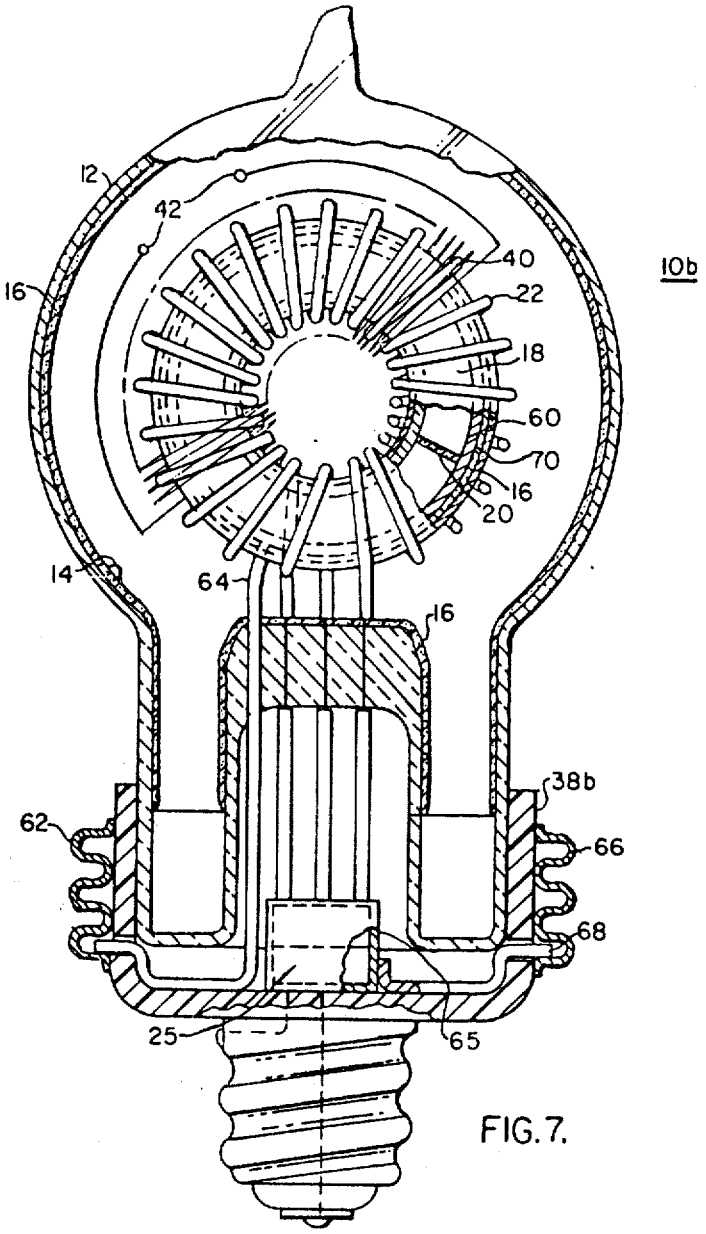
In FIG. 7 is set forth an elevational view, partly in section, of still another alternative lamp embodiment wherein a heat-conductive metallic member is affixed to the core, with an additional heat-conducting member to transfer heat from the core to an external radiator, and a second heat transferring member is provided to transfer heat from the casing of the power source to an external radiator.

In FIG. 7 is shown yet another lamp embodiment 10*b* which generally corresponds to the embodiment 10 shown in FIG. 3 except that a heat conductive metallic member such as a band of copper 60 is positioned about the ferrite core 18 in heat transfer relationship therewith. An additional heat sink member 62 such as a radiator is affixed to the exterior of the lamp base member 38*b*. The copper strip 60 which encases the exterior of the core is maintained in heat transferring relationship with the radiator 62 by means of an additional copper conductor member 64. As another possible embodiment, a metallic casing 65 provided for the power source 25 is maintained in heat transfer relationship with a second radiator member 66 by means of an additional conductor 68.

In any of the foregoing embodiments, it is desirable to insulate the winding 22 from the ferrite core and this is readily accomplished by providing the core with a layer 70 of a refractory-type inorganic cement such as that marketed by Sauereisen Cement Co., Pittsburgh, PA, and sold under the trademark "Sauereisen Cement", which is a zirconia-based cement. A typical thickness for the layer 70 is 0.05 to 0.1 mm. Other materials which can be used to coat the ferrite core to insulate the same from the winding are a devitrifying glass such as that marketed by Corning Glass Co., under the trademark "Pyroceram". Alternatively, the winding 22 can be provided with a layer of glass or fiberglass insulation thereabout.

In the preferred embodiment, the gap means has been described as fabricated of a mica spacer. Other materials can be substituted therefor such as a disc of alumina, zirconia, magnesia, or strontium oxide, for example. Alternatively, the gap need not have a filler and the atmosphere of the lamp can constitute the low-permeability substance.

While the gap lowers the effective permeability of the core, for lamp embodiments such as described hereinbefore, it is desirable that the effective permeability of the core should not be decreased to less than about 200, and this of course is a substantial reduction from the permeability which is normally obtained with ferrite per se.

Many different energizing type circuits can be used to replace the specific examples described hereinbefore. It is highly desirable, however, to use an energizing circuit which incorporates a tuned circuit output with the core comprising a part of the tuned circuit and in such cases, the gap which is provided in accordance with the present invention provides the dual benefits of a stabilized frequency of operation and suppression of harmonics.

The lamp embodiments as described hereinbefore can be modified substantially. For example, the power source need not be mounted in the envelope neck, but can be separately mounted, such as by a standard screw-type base member which fits into a standard incandescent socket. The lamp per se can then be plugged into or otherwise affixed to the power source, so that either the lamp or the power source can be separately replaced.

The incorporation of the low permeability, narrow gap or gaps in the cores provides additional advantages with respect to lamp assembly. For example, if the core is to be physically isolated from the environment within the sealed envelope, but operatively positioned in energy transferring relationship with respect to the environment within the envelope, and the core also is formed as a closed loop of magnetic material, fabrication problems may be presented, such as outlined in the referenced U.S. Pat. No. 4,005,330. More specifically, referring to FIG. 4 of this patent, the totally fabricated core has inserted therein a glass sleeve which is then fused onto the glass reentrant member, with the mounted core and reentrant portion thereafter sealed into the lamp envelope.

In accordance with the present invention, when providing the gap means of low permeability, the cores can be initially fabricated as separate portions and thereafter assembled by using a cement or adhesive. In addition, since the core can be isolated from the discharge-sustaining environment within the lamp envelope, for some embodiments the core segments can be joined together by the use of relatively easy-to-handle adhesives, such as conventional epoxy cement. If such cements were to be used with a core which was exposed to the operating environment within the lamp envelope, the ultraviolet radiations generated would normally cause the epoxy cements to degrade, with the products of decomposition deleteriously affecting lamp performance.

A variety of embodiments wherein the core is physically isolated from the environment within the sealed envelope, but also operatively positioned in energy transferring relationship with respect to the environment within the sealed envelope are shown in FIGS. 8 through 18 and these embodiments are representative of the lamp design flexibility which is provided by making the core in separate sections and thereafter assembling these sections, preferably with the low permeability gaps included as a part of the jointures between the core sections.

Figure 8:
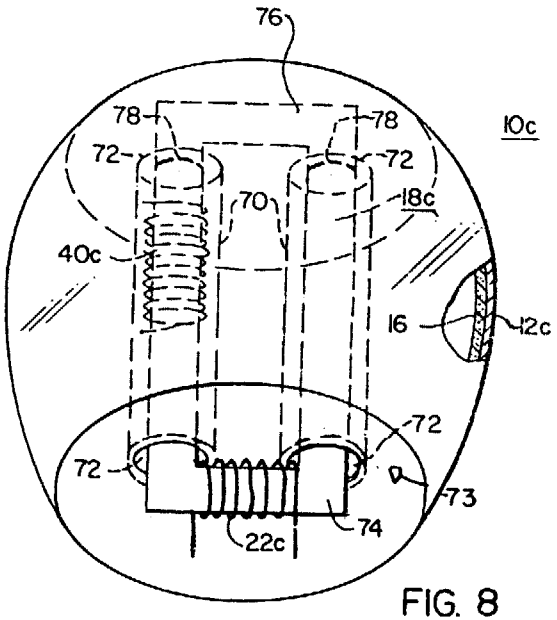
FIG. 8 is an isometric view, partly broken away, of the envelope and core portion of yet another alternative lamp embodiment wherein the wound core is isolated from the discharge-sustaining environment within the envelope, with the core being in energy transferring relationship with respect to the environment within the envelope.
Figure 9:
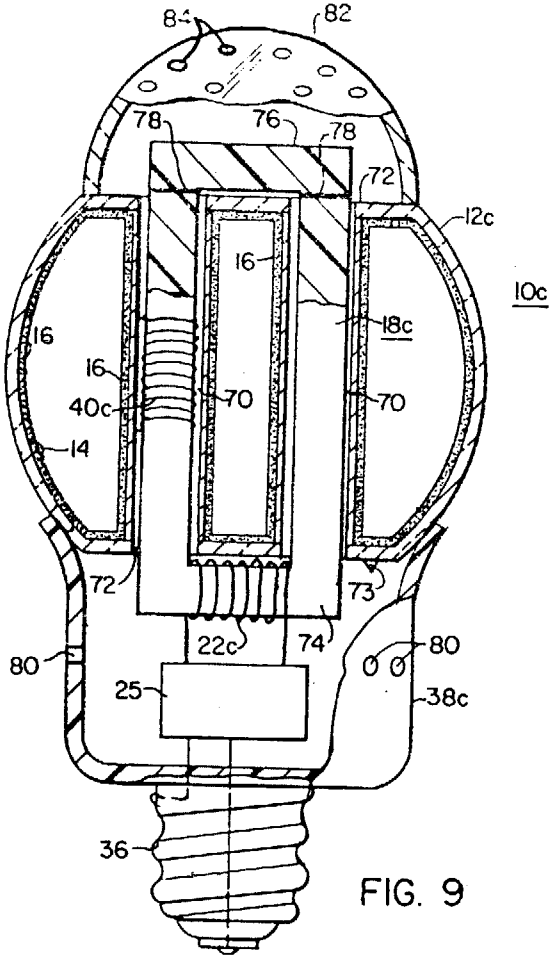
FIG. 9 is an elevational view, partly broken away, showing the alternative lamp embodiment which incorporates the envelope and core as shown in FIG. 8.

In the lamp embodiment 10*c* as shown in FIGS. 8 and 9, the envelope 12*c* has a generally cylindrical configuration and is provided with two vitreous passageways 70 which have a hollow, elongated configuration and extend through the envelope 12*c* in the same direction, with the terminal ends 72 of the passageways being open. After the envelope is phosphor coated and lehred to drive out the products of decomposition of the binder material, as is conventional, to deposit the phosphor coating 16, the envelope processing is completed by baking, evacuating, and dosing with the discharge-sustaining filling through a tip-off 73. Thereafter, the core is inserted through the elongated passageways 70 for mounting in energy-transferring relationship with respect to the environment within the processed envelope 12*c*. In such an embodiment, the core 18*c* is formed of at least two separate portions, one of which portions 74 has a U-shaped configuration with the other portion 76 conformed to be adhered proximate the ends of the U-shaped portion 74. The two core portions are affixed to one another by the simple expedient of a suitable cement, such as a conventional epoxy cement, and the spacing of low permeability material, which provides the gap means 78 can be formed of a thin disk of mica cemented to join together the separate core portions. In such an embodiment, the gap 78 can be formed of a single mica disk or two disks can be used. In other respects, the winding 22*c* is generally as described hereinbefore and starting is provided by the winding 40*c* which is capacitively coupled through the vitreous wall of the passageway 70. In other respects the lamp 10*c* is similar to the previous embodiments including the phosphor coating 16 and discharge-sustaining filling such as a small amount of mercury 14. For purposes of illustration, only a portion of the phosphor coating 16 is shown.

A practical lamp embodiment 10*c* is shown in FIG. 9 wherein the modified envelope 12*c* is affixed to a modified hollow base adaptor 38*c*, which contains the energizing circuitry 25 and which in turn is connected to the conventional screw-type base 36. Such a construction has additional advantages since the lamp or device 10*c* can be designed for operation in such an orientation that the passageways 70 are vertically disposed, in order to provide a chimney effect through the passageways 70 and permit cooling of the fabricated core 18*c* during lamp operation. To facilitate such cooling, the hollow base adaptor 38*c* is provided with apertures 80 therethrough and the lamp is also provided with a light transmitting top cap 82 which also has apertures 84 provided therethrough to complete the chimney effect. To protect the epoxy cement portion of the gaps 78 from being exposed to the ultraviolet radiations which are generated within the envelope 12*c* during lamp operation, the passageways can be formed of glass which transmits substantially no ultraviolet radiations, such as the conventional soda-lime-silica glass. Alternatively, conventional ultraviolet reflecting materials can be coated over the envelope-interior surfaces of the passageways 70 and such coatings are well known.

Figure 10:
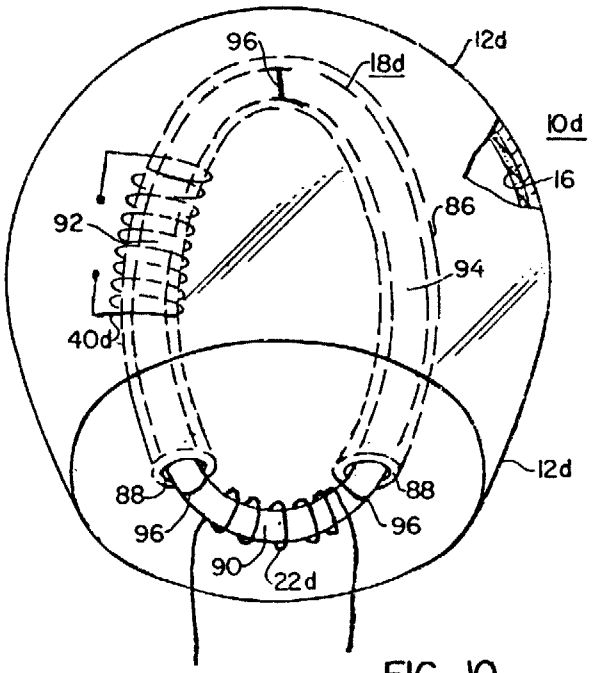
FIG. 10 is an isometric view, partly broken away, of the envelope and core portion of still another alternative lamp embodiment wherein the wound core is isolated from the environment within the envelope.
Figure 11:
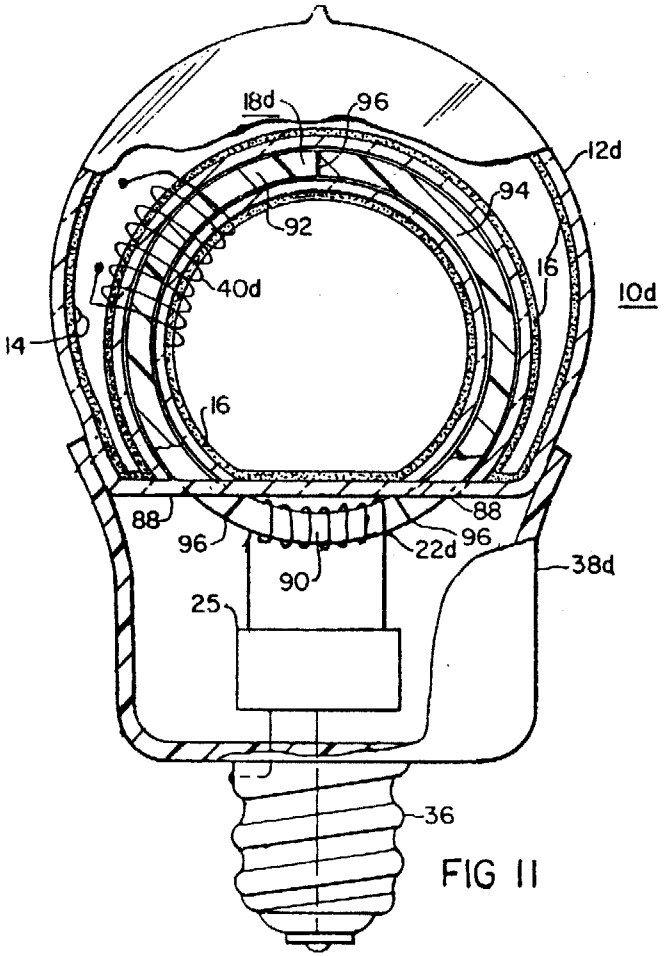
FIG. 11 is an elevational view, partly broken away, of the lamp embodiment which incorporates the envelope and core as shown in FIG. 10.

In FIGS. 10 and 11 are shown another device embodiment 10*d* wherein the modified envelope 12*d* is provided with a hollow, elongated curved passageway 86 which is sealed from the discharge-sustaining medium within the envelope and which may be formed of vitreous substance such as soft or hard glass. The ends 88 of the hollow curved passageway 86 open through the wall of the envelope 12*d* and after the envelope interior is coated with phosphor 16 and lehred, and thereafter completely processed by baking, evacuating and dosing with the mercury discharge-sustaining filling 14, the core 18*d* is assembled therein by joining together three core pieces 90, 92 and 94 with a suitable cement such as epoxy, with suitable low permeability spacers included at least at one of the jointures 96. For purposes of illustration, only a portion of the phosphor coating 16 is shown. The starting winding 40*d* in this embodiment is wrapped on the exterior portion of the curved tubular member 86 so that it is magnetically coupled to the core 18*d* after it is assembled, in order to facilitate starting of the device 10*d*. The device 10*d* as assembled in a practical form is shown in FIG. 11 wherein the envelope 12*d* is sealed to a hollow base adaptor means 38*d* which has the energizing circuitry 25 contained therein and which connects to a winding 22*d* and base 36 in the manner as described hereinbefore.

Figure 16:
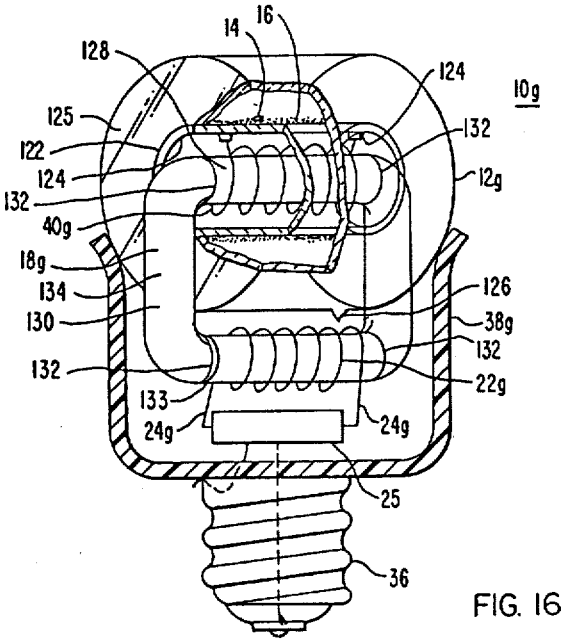
FIG. 16 is an isometric view, partly broken away and shown partly in section, of yet another lamp embodiment wherein the envelope is provided with a single passageway therethrough which receives a segment portion of the ferrite core, with the remainder of the core formed with a looped configuration and retained outside the sealed envelope.
Figure 18:
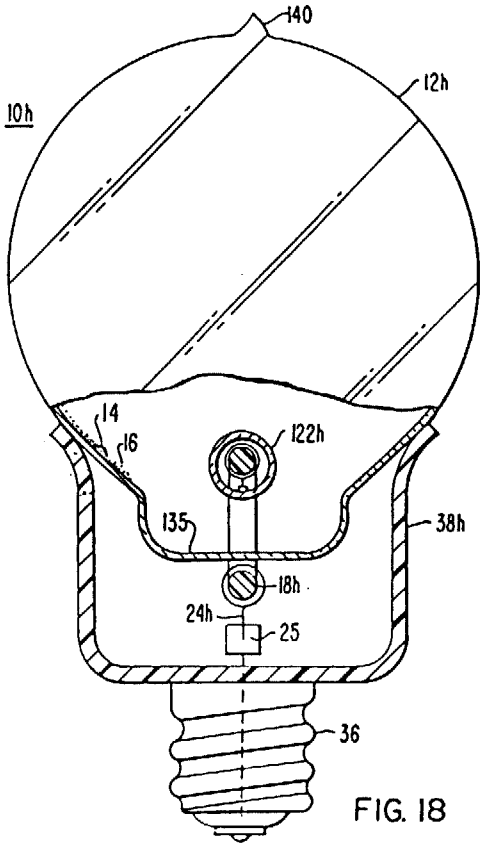
FIG. 18 is a side elevational view, shown partly in section, of the lamp embodiment as shown in FIG. 17.
Figure 17:
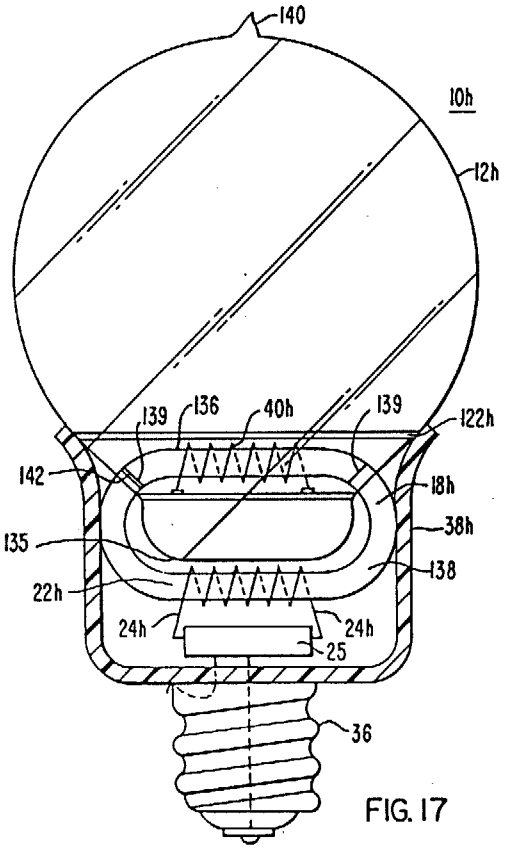
FIG. 17 is an elevation view, shown partly in section, of still another lamp embodiment wherein the envelope is provided with a single passageway therethrough which is offset toward one end of the envelope, with the single passageway enclosing a segment portion of the ferrite core, and with the remainder of the core formed with a looped configuration outside the envelope and positioned within the base portion of the lamp.

In device embodiments as shown in FIGS. 8–11 and also FIGS. 16–18, the envelopes can be totally fabricated and processed without exposing the core portions of the devices to the temperature extremes which are required for envelope processing. In explanation, and referring to FIGS. 8–11, the envelopes 12*c* and 12*d* are fabricated of light-transmitting material such as glass and are adapted to be evacuated and sealed. Enclosed within the envelopes are hollow conduit-type passageway means (70 in FIG. 8 and 86 in FIG. 10), with the terminal portions of the passageway means 72 in FIG. 8 and 88 in FIG. 10 sealed to and opening through different portions of the walls of the respective envelopes. The respective terminal portions of the passageways remain open to permit the later insertion therein of segment portions of the cores of the devices.

In processing the fabricated envelopes 12*c* and 12*d* for these device embodiments, there is first applied to the interior surfaces of the envelopes a phosphor coating composition. Such phosphor coating compositions are well known in the art and a typical composition is described in U.S. Pat. No. 3,833,392, dated Sept. 3, 1974 to Repsher et al. Such a composition incorporates a viscosity-imparting organic binder and after the composition is applied, it is necessary to lehr the envelopes at a relatively high temperature in order to decompose and burn out the organic binder. As an example, temperatures in the order of 525° C. and over are required.

After the envelopes are lehred to complete the phosphor coating processing, the envelopes are allowed to cool and then baked and evacuated to remove occluded gases and other impurities, and a typical baking temperature is 450° C. Alternatively, the lehring and baking can be performed as one step. The heated envelopes are then evacuated and dosed with a discharge-sustaining filling such as the small charge of mercury 14 and a low pressure of inert ionizable starting gas such as the 1.5 torrs of argon. The envelopes are then hermetically sealed by tipping off the filling tubulation, such as 73 as shown in FIGS. 8 and 9.

In the steps as described hereinbefore, the envelopes are essentially completely processed without exposing the core portions of the devices to the temperature extremes required for proper envelope processing. Therreafter, there is inserted into a hollow passageway means an elongated segment of the core which principally comprises the magnetic material of high permeability. In the embodiment 10*c* as shown in FIG. 8 this is the core portion 74, and in the embodiment 10*d* as shown in FIG. 10, this is the joined core portion formed by the cemented segments 92 and 94. There is then cemented to the ends of the inserted core segment an additional elongated segment of the core, such as the segment 76 as shown in FIG. 8 or the segment 90 as shown in FIG. 10. The inserted core segment and the additional core segment, as cemented together, have a looped configuration with at least a portion of the additional core segment projecting exteriorly of the fabricated envelope. In this manner, neither the core nor the segmented jointures thereof are exposed to any of the high temperatures required for envelope processing with the additional advantages that temperature degradable cements, such as epoxies, can be used. In the preferred embodiments, at least one of the cemented jointures between the core segments includes as a part thereof a thin spacing comprising the low-magnetic-permeability material, with the preferred material comprising mica included in the jointure or jointures between the elongated core segments.

Figure 12:
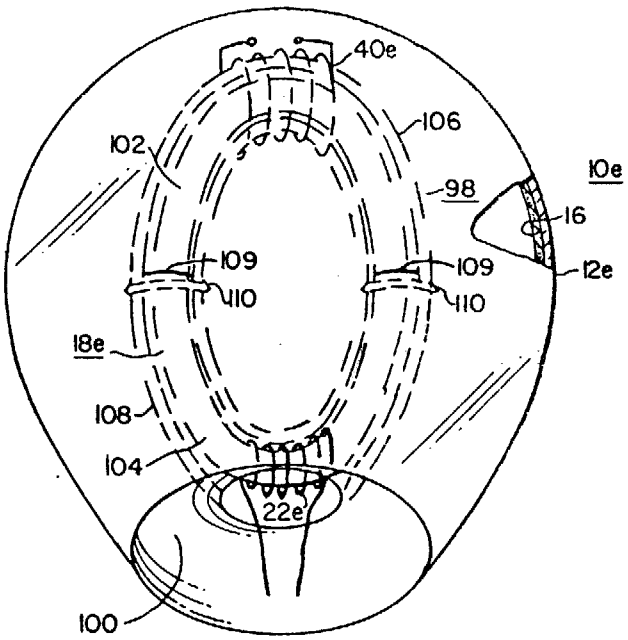
FIG. 12 is an isometric view, partly broken away, of the envelope and core portion of still another alternative embodiment wherein the core is isolated from the discharge-sustaining environment within the envelope.
Figure 13:
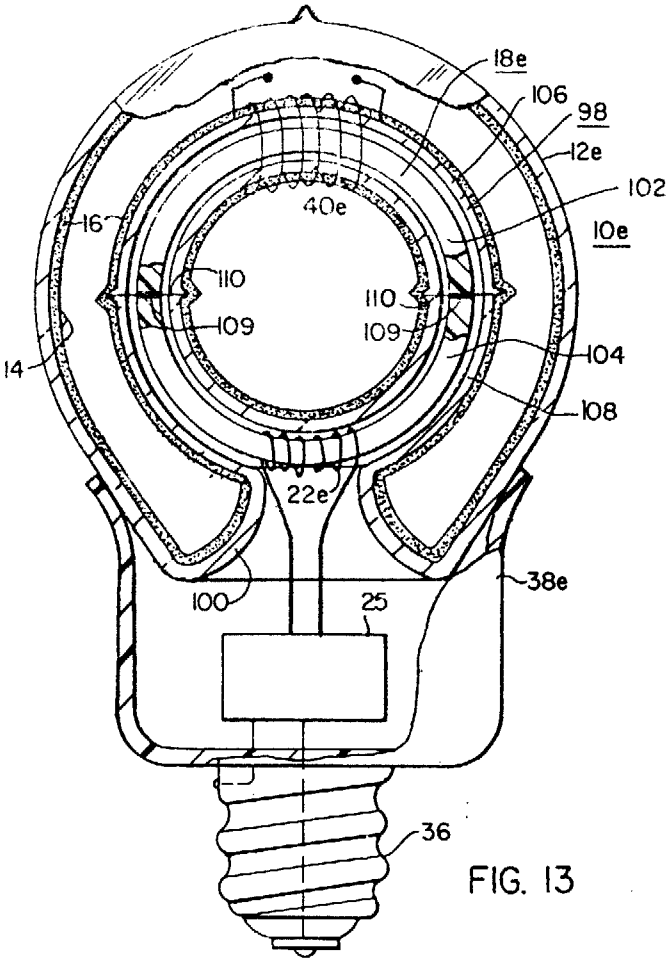
FIG. 13 is an elevational view, shown partly in section, of the alternative lamp embodiment which incorporates the envelope and core portion as shown in FIG. 12.

Still another lamp embodiment 10*e* is shown in FIGS. 12 and 13 wherein a hollow, elongated closed-loop passageway 98, which is formed of suitable material such as glass, is provided within the envelope and a glass conduit member 100 is sealed through the envelope 12*e* and opens into the passageway 98. In this manner, the interior of the passageway is isolated from the discharge-sustaining medium which is enclosed by the envelope 12*e*. To fabricate such an embodiment, the separate core sections 102 and 104 are first inserted into two semicircular glass tubes 106 and 108, one of which has the conduit 100 affixed thereto. The separate core members are then cemented with the low permeability material gap means 109 included at the jointure and the separate glass members are then fused together at their jointure 110. Prior to mounting the core 18*e* in these glass members, it is desirable to phosphor coat the exterior of the glass tubes so that the core 18*e* is not subject to the lehring temperatures. Thereafter, the core is inserted into the semicircular tubes. To facilitate lamp bake-out during final fabrication, it is desirable to affix the separate core pieces 102 and 104 together with a relatively high temperature cement, such as the previously described refractory-type zirconia-based cement sold under the trademark "Sauereisen Cement". As in the previous embodiments, only a portion of the phosphor coating 16 is shown.

A practical embodiment of the lamp 10*e* is shown in in FIG. 13 wherein the envelope 12*e* is sealed at its neck portion to a hollow base-adaptor means 38*e*. As in the previous embodiments, the inner surface of the envelope 12*e* carries the phosphor coating 16 and is provided with the discharge-sustaining filling of mercury 14. The winding 22*e*, starting winding 40*e*, power source 25 and base 36 are generally similar to the previous embodiments.

Figure 14:
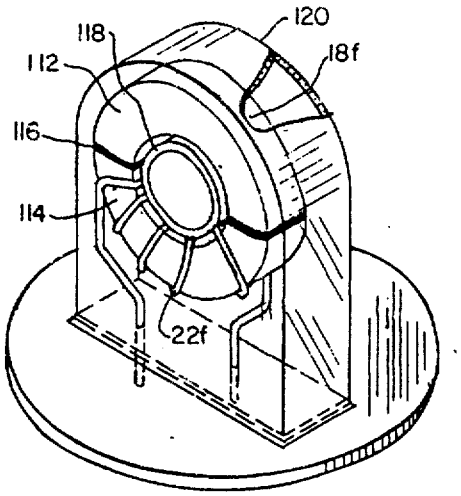
FIG. 14 is an isometric view, shown partly in section, of yet another alternative embodiment of a core mounting structure wherein the core is mounted within an envelope reentrant portion.
Figure 15:
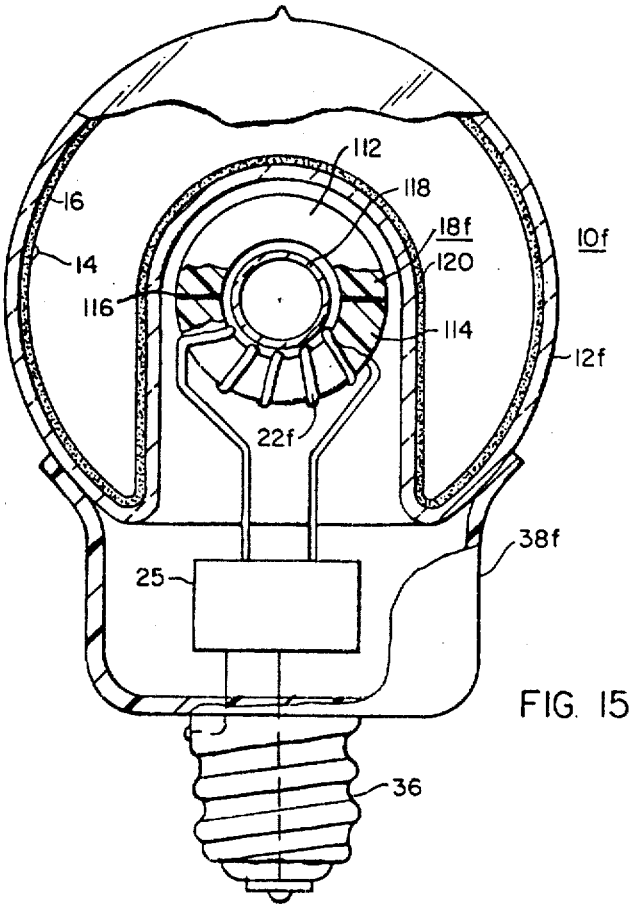
FIG. 15 is an elevational view, shown partly in section, of a lamp which incorporates the envelope reentrant portion which in turn incorporates the wound core as shown in FIG. 14.

In FIGS. 14 and 15 are shown a modified device 10*f* which generally conforms to the construction as shown in U.S. Pat. No. 4,005,330 referred to hereinbefore, except that the magnetic core is not formed as a closed loop but is formed as separable core portions 112 and 114 which together form the composite core 18*f* after being cemented together at their jointure to form the low-permeability gaps 116. The winding 22*f* is carried on the core portion 114. Again, in such an embodiment it is desirable to cement the separate core portions together with the hereinbefore referenced refractory-type zirconia-based cement, in order to insure the core cemented portions are not damaged during lamp baking. The use of the separate core portions facilitates lamp fabrication since the glass conduit 118 which passes through the center of the core 18*f* may be sealed to the sides of the envelope reentrant portion 120 before the core sections are fitted thereover and cemented together. In the lamp as assembled the reentrant portion 120 has a phosphor coating 16 applied thereover.

The fabricated lamp 10*f* is shown in FIG. 15 wherein the reentrant portion 120 with the core 18*f* mounted therein is sealed into the neck portion of the envelope 12*f*. As in the previous embodiments, a hollow base adaptor 38*f* is sealed to the neck of the envelope 12*f* and contains the power source 25 which connects to the conventional screw-type base 36. The inner surface of envelope 12*f* is provided with the phosphor coating 16 and a small charge of mercury 14 is included.

In all of the embodiments as shown in FIGS. 8–18 and as described, any out-gassing problems which may be encountered with the cores during lamp operation are eliminated. Also, in those embodiments where core exposure to lamp baking temperatures and phosphor lehring temperatures can be eliminated, the low permeability gap means which are provided in accordance with the present invention can be included simply by cementing low permeability disc means in place between separate core portions by use of a conventional cement, such as epoxy cement, since the jointures between the separate core portions are not exposed to ultraviolet radiations which can degrade organic-type cements or to the temperatures required for lamp processing. Thus, by fabricating the cores as separate pieces, which can then be affixed together as unitary members with the low permeability gap or gaps included therein, the performance of the devices can be substantially improved.

In any of the embodiments as described hereinbefore, the dimensions of the low permeability gap or gaps can be very carefully controlled, and the permeability of the gap or gaps is very stable. Since these low-permeability gap members are the primary factor in determining the effective permeability of the composite core, the devices can be made readily reproducible and their performance under varying conditions of operation is improved with respect to stability, as compared to an otherwise similar device which incorporates a closed loop magnetic core.

While mercury is the preferred discharge-sustaining substance, other discharge-sustaining substances can be substituted therefor, an example being cadmium plus the inert, ionizable starting gas.

In FIG. 16 is shown in isometric view still another lamp embodiment 10*g* wherein the envelope portion 12*g* is provided with a generally cylindrical configuration and with a hollow, elongated, conduit-like passageway means 122 extending axially through the envelope 12*g*, with the end portions 124 of the passageway 122 sealed to and opening through the end walls 125 of the cylindrical envelope 12*g*. In such a construction, the environment within the passageway 122 is sealed from the environment within the envelope 12*g*. As in the previous embodiments, the interior surface of the envelope 12*g* is coated with a layer of phosphor material 16 and the environment within the envelope includes a small charge of mercury 14 and a small pressure of inert, ionizable, starting gas, in order to provide a discharge-sustaining environment when the device 10*g* is energized. In such a construction, the envelope portion 12*g* of the device is fabricated by phosphor coating through a suitable tubular member 126, lehring, evacuating and dosing with the discharge-sustaining medium, after which the tubular 126 is tipped off to provide a sealed and completely fabricated envelope. In the showing of FIG. 16, only a small portion of the phosphor layer 16 has been shown for purposes of illustration.

After the envelope is fabricated, the lamp assembly is completed by inserting through the passageway 122 a segment portion 128 of the modified ferrite core 18g. The remaining portion 130 of the core is then affixed to the inserted core portion 128, either by suitable cement such as epoxy resin or by other retaining means such as a mechanical clamp mechanism. As in the previous embodiments, a starting winding 40g is wrapped about the segment 128 of the core which projects through the passageway 122 and the power winding 22g for the core connects through suitable lead-in members 24g to a radio frequency power source 25. A suitable base member 38g which can be fabricated of plastic is affixed to the envelope 12g and in turn has a suitable base adapter 36 affixed thereto for energizing the lamp.

In the embodiment as shown, the core 18g is formed of four separate segments affixed to one another by a suitable retaining means or cement at the jointures 132. As in the previous embodiments, for best performance of the device, it is desirable to include a low permeability spacer or gap 133 at least at one of the jointures 132 which traverses the cross section of the core, in order to realize the attendant advantages as described hereinbefore. In the case of some oscillators, however, with a Class D oscillator being an example, the gap means 133 comprising low permeability material can be dispensed with and the individual core segments affixed directly to one another. In such an embodiment, the envelope is completely fabricated without exposing the core to the high envelope processing temperatures and if it is desired to utilize a degradable type adhesive to join the core segments together, this adhesive can readily be protected from the deleterious effects of the ultraviolet radiations generated within the operating envelope. The portion of the core 18g which is exterior to the envelope 12g is preferably provided with a reflecting coating 134 to minimize light absorption.

In FIGS. 17 and 18 are shown still another lamp embodiment 10h wherein the single conduit-type passageway 122h extends through the envelope 12h in such a fasion as to provide a relatively constricted spacing between the single passageway 122h and a proximate wall portion 135 of the envelope 12h. The looped core 18h is conformed to extend through the passageway 122h and to loop about the exterior of the envelope wall portion 135 which is proximate the passageway 122h. In this fashion, the core is physically isolated from the environment within the sealed envelope, but is operatively positioned in energy transferring relationship with respect to the discharge-sustaining environment within the envelope 12h. As in the previous embodiment, the core is formed of at least two separate segments 136 and 138 held together by suitable retaining means, either a mechanical clamp or some suitable adhesive such as epoxy cement at the core jointures 139. As in the previous embodiment, a starting winding 40h is provided within the passageway 122h wrapped about the core segment 136 and a power winding 22h is wrapped about the core segment 138 and connects through lead-in conductors 24h to a radio frequency power source 25. A suitable base member adapter 38h is affixed to the envelope and has projecting therefrom a suitable screw-type base adapter 36 to connect the lamp to a power source. Only a portion of the phosphor layer 16 is shown for purposes of illustration with the discharge-sustaining medium comprising a small charge of mercury 14 and the usual inert, ionizable starting gas. As in the previous embodiment, the envelope is first totally fabricated and sealed at the top tip off 140, with the ferrite core thereafter inserted through the passageway 122h and the lamp fabrication completed so that the core is not exposed to the operating environment within the envelope and the relatively high processing temperatures which are required to complete the envelope fabrication. Preferably at least one of the core jointures 139 includes the gap means 142 comprising the low-permeability material, such as a mica spacer.

What is claimed is:

1. An electrodeless discharge device designed to operate with a rated power consumption when energized with predetermined radio frequency energy as generated by a radio-frequency power source, said radio-frequency power source having an output portion comprising a tuned circuit having a resonant frequency which approximates said predetermined radio frequency at which said device is to be operated, said device comprising:

a. a sealed light-transmitting globular-shaped envelope of predetermined dimensions; a discharge-sustaining medium within said envelope; and a layer comprising phosphor material carried on the interior surface of said envelope;

b. a core at least partially contained within and operatively positioned within said envelope, said core principally comprising magnetic material of high permeability and having a looped configuration of predetermined dimensions and also having predetermined cross-sectional dimensions, and said core also including narrow gap means comprising low-permeability substance traversing the cross section of said core; and a winding having a predetermined number of turns wrapped about said core;

c. lead-in members connecting to said winding for connection to said radio-frequency power source; said core comprising a part of said tuned circuit output portion of said radio-frequency power source, and the magnetic permeability of said core constituting a principal variable factor which can cause the resonant frequency of said tuned circuit output portion to vary; and during operation of said device, the radio-frequency energy passed through said winding creates radio-frequency electromagnetic fields through and about said core and within said envelope to excite said discharge-sustaining medium to emit short wavelength radiations, and said layer comprising phosphor is responsive to said short wavelength radiations to emit visible radiations which pass through said envelope; and d. during operation of said device, said gap means in said core stabilizes the effective permeability of said core so that substantial changes in the permeability of the principal material of siad core reflect only as minor changes in the effective permeability of said gapped core, which stabilizes the operating resonant frequency of said tuned circuit output portion; and said gap means in said core also substantially increases the Q of said tuned circuit, as compared to the Q of an otherwise similar tuned circuit which incorporates a core formed entirely of said principal core material, to substantially increase the selectivity of said tuned circuit output portion to suppress output harmonics of said resonant frequency of said tuned circuit output portion.

2. The device is specified in claim 1, wherein means are provided to ionize the discharge-sustaining medium contained within said envelope to initiate the operation of said device.

3. The device as specified in claim 2, wherein an additional winding having a predetermined and relatively large number of turns is carried on said core, said additional winding terminating in end portions spaced apart a predetermined distance within said envelope, when said tuned circuit is initially energized said additional winding having generated between the spaced end portions thereof of a relatively high voltage, and the capacitive coupling between said spaced end portions of said additional winding ionizing the discharge-sustaining medium within said envelope to initiate the operation of said device.

4. The device as specified in claim 1, wherein said magnetic material of high permeability is ferrite.

5. The device as specified in claim 1, wherein said core has an effective magnetic permeability of at least about 200.

6. The device as specified in claim 1, wherein additional phosphor material is carried as a coating on the surface of said core.

7. The device as specified in claim 1, wherein said winding carried on said core is electrically insulated from said core.

8. The device as specified in claim 1, wherein heat conductive metallic means is affixed to said core in heat transferring relationship therewith, heat-sink means are positioned exteriorly of said envelope, and heat-transferring means is affixed to said heat conductive metallic means and is sealed through said envelope and connects to said heat sink means to transfer generated heat from said core to a location exteriorly of said envelope.

9. The device as specified in claim 1, wherein said envelope has an elongated neck portion extending therefrom, and said radio-frequency power source is mounted in said elongated envelope neck portion.

10. The device as specified in claim 9, wherein additional heat-sink means are positioned exteriorly of said envelope, said radio-frequency power source is mounted within a metallic casing, and additional heat-transferring means connect to said metallic casing for said power source and to said additional heat-sink means.

11. An electrodeless discharge device designed to operate with a rated power consumption when energized with predetermined radio frequency energy as generated by a radio-frequency power source, said radio-frequency power source having an output portion comprising a tuned circuit having a resonant frequency which approximates said predetermined radio frequency at which said device is to be operated, said device comprising:

a. a sealed light-transmitting envelope of predetermined dimensions; a discharge-sustaining medium within said envelope; and a layer comprising phosphor material carried on the interior surface of said envelope;

b. a core operatively positioned in energy transferring relationship with respect to the environment within said envelope, said core principally comprising magnetic material of high permeability and having a looped configuration of predetermined dimensions and also having predetermined cross-sectional dimensions, and said core also including narrow gap means of predetermined dimensions comprising low-permeability substance traversing the cross section of said core; and a winding having a predetermined number of turns wrapped about said core; and c. lead-in members connecting to said winding for connection to said radio-frequency power source; said core comprising a part of said tuned circuit output portion of said radio-frequency power source, and the magnetic permeability of said core constituting a principal variable factor which can cause the resonant frequency of said tuned circuit output portion to vary; and during operation of said device, the radio-frequency energy passed through said winding creates radio-frequency electromagnetic fields through said core and within said envelope to excite said discharge-sustaining medium to emit short wavelength radiations, and said layer comprising phosphor is responsive to said short wavelength radiations to emit visible radiations which pass through said envelope; whereby the effective permeability of said core is determined primarily by said gap means and said gap means increases the Q of said tuned circuit, as compared to the Q of an otherwise similar tuned circuit which incorporates a core formed entirely of said principal core material.

12. An electrodeless discharge device designed to operate with a rated power consumption when energized with predetermined radio frequency energy as generated by a radio-frequency power source, said radio-frequency power source having an output portion comprising a tuned circuit having a resonant frequency which approximates said predetermined radio frequency at which said device is to be operated, said device comprising:

a. a sealed light-transmitting envelope of predetermined dimensions; a discharge-sustaining medium within said envelope; and a layer comprising phosphor material carried on the interior surface of said envelope;

b. a core physically isolated from the environment within said sealed envelope but operatively positioned in energy transferring relationship with respect to the environment within said envelope, said core principally comprising magnetic material of high permeability and having a looped configuration of predetermined dimensions and also having predetermined cross-sectional dimensions, and said core also including narrow gap means comprising low-permeability substance traversing the cross section of said core; and a winding having a predetermined number of turns wrapped about said core; and c. lead-in members connecting to said winding for connection to said radio-frequency power source; said core comprising a part of said tuned circuit output portion of said radio-frequency power source, and the magnetic permeability of said core constituting a principal variable factor which can cause the resonant frequency of said tuned circuit output portion to vary; and during operation of said device, the radio-frequency energy passed through said winding creates radio-frequency electromagnetic fields through said core and within said envelope to excite said discharge-sustaining medium to emit short wavelength radiations, and said layer comprising phosphor is responsive to said short wavelength radiations to emit visible radiations which pass through said envelope; whereby the effective permeability of said core is determined primarily by said gap means and said gap means increases the Q of said tuned circuit, as compared to the Q of an otherwise similar tuned circuit which incorporates a core formed entirely of said principal core material.

13. The device as specified in claim 12, wherein said core is formed of at least two separate portions which are affixed to one another by cement means, and said core portions and said affixing cement means are isolated from the discharge-sustaining environment within said sealed envelope as well as the short wavelength radiations generated within said envelope during operation of said device.

14. The device as specified in claim 12, wherein two hollow elongated passageways are provided within said envelope with the environment within said passageways sealed from the discharge-sustaining medium within said envelope, said passageways extend through said envelope in the same direction with the terminal ends thereof being open, said core is formed of at least two separate portions which as assembled extend within and through said passageways and connect exteriorly of said passageways to provide a looped configuration, and the separate portions of said core are joined together by cement means.

15. The device as specified in claim 14, wherein at least one of the jointures between said separate core portions include said gap means.

16. The device as specified in claim 15, wherein said device has a predetermined operational orientation, said passageways through said envelope are substantially vertical when said device is positioned in its intended operational orientation, and said passageways provide a chimney effect to enhance the cooling effects for said core.

17. The device as specified in claim 16, wherein hollow base adaptor means is affixed to said envelope to facilitate affixing said device to a source of electrical energy, and said base adaptor means has ventilating apertures provided therein to permit the ambient atmosphere to enter into said base adaptor means and thence through said passageways through said envelope to effect a cooling of said core during operation of said device.

18. The device as specified in claim 15, wherein said cement means is subject to compositional change when subjected to the environment within said envelope of said device as operated, and said passageways are substantially impervious to the short wavelength radiations generated within said envelope during operation of said device, whereby said cement means is protected from compositional change during operation of said device.

19. The device as specified in claim 12, wherein a hollow elongated curved passageway is provided within said envelope with the environment within said passageway sealed from the discharge-sustaining medium within said envelope, the ends of said passageway opening through the wall portion of said envelope, said core is formed of at least two separate portions which as assembled extend within and through said passageway and meet exteriorly of said envelope to provide a looped configuration, and the separate portions of said core are joined together by means.

20. The device as specified in claim 19, wherein at least one of the jointures between said separate core portions include said gap means.

21. The device as specified in claim 20, wherein said cement means is subject to compositional change when subjected to the environment within said envelope of said device as operated, and said passageway is substantially impervious to the short wavelength radiations generated within said envelope during operation of said device, whereby said cement means is protected from compositional change during operation of said device.

22. The device as specified in claim 12, wherein a hollow elongated closed-loop passageway is provided within said envelope, the environment within said passageway is sealed from the discharge-sustaining medium enclosed by said envelope, a conduit member is sealed through said envelope and opens into said passageway to connect to said passageway, said core is formed of at least two separate portions which as assembled are contained within said passageway and have a looped configuration generally conforming to the configuration of said passageway, and the separate portions of said core are joined together by high-temperature-resistance cement means.

23. The device as specified in claim 12, wherein said envelope has a reentrant portion which is sealed from the discharge-sustaning atmosphere within said envelope, said core is at least partially mounted within said envelope reentrant portion, and a sealed conduit passes through said core and opens into said envelope so that the environment within said conduit is the discharge-sustaining environment as contained within said envelope.

24. The method of processing and assembling the envelope and looped core portion of an electrodeless discharge device without exposing the core portion thereof to the temperature extremes required for envelope processing sing, which method comprises:

a. fabricating a light-transmitting envelope of predetermined configuration and which is adapted to be evacuated and sealed and which has enclosed therein hollow conduit-type passageway means, said passageway means having terminal portions sealed to and opening through different portions of the wall of said envelope with said terminal portions of said passageway means being open to permit the later insertion therein of core segment portion means;

b. applying a phosphor coating composition to the interior surface of said envelope, and lehring said envelope and applied phosphor coating composition to complete the phosphor coating processing;

c. evacuating said coated envelope in a heated condition and dosing said envelope with a discharge-sustaining filling, and hermetically sealing said dosed envelope to complete the essential envelope processing steps;

d. thereafter inserting into said hollow passageway means elongated core segment portion which principally comprises magnetic material of high permeability, affixing to the ends of said inserted core segment portion means additional elongated core segment portion means, and said inserted core segment portion means and said additional core segment means as affixed together having a looped configuration with at least a portion of said additional core segment portion means projecting exteriorly of said envelope; whereby said looped core and the affixed jointures thereof are not exposed to the high temperatures required for envelope processing.

25. The method as specified in claim 24, wherein at least one of said affixed jointures between said core segment portion means includes as a part thereof a thin spacing comprising low-magnetic-permeability material.

26. The method as specified in claim 25, wherein said low-magnetic-permeability material comprises mica, and said elongated core segment portion means are ferrite.

27. An electrodeless discharge device designed to operate with a rated power consumption when energized with predetermined radio-frequency energy as generated by a radio-frequency power source, said radio-frequency power source having an output comprising a tuned circuit having a resonant frequency at which said device is to be operated, said device comprising:

a. a sealed light-transmitting envelope of predetermined dimensions; hollow enlongated conduit-like passageway means extending through said envelope with the end portions of said passageway means sealed to and opening through the walls of said envelope at different locations thereon, the environment within said passageway means being sealed from the environment within said envelope; a discharge-sustaining medium comprising the environment within said sealed envelope; and a layer comprising phosphor material carried on the interior surface of said envelope;

b. a core physically isolated from the environment within said sealed envelope but operatively positioned in energy transferring relationship with respect to the environment within said envelope, said core having a looped configuration principally comprising magnetic material of high permeability, a predetermined portion of said looped core extending through said passageway means and the remainder of said core positioned exteriorly of said passageway means, and said core being formed of at least two separate segments held together by retaining means;

c. a power winding having a predetermined number of turns wrapped about said core; lead-in members connecting to said winding for connection of said radio-frequency power source; said core comprising a part of said tuned circuit output portion of said radio-frequency power source; and during operation of said device, the radio-frequency energy passed through said power winding creates radio-frequency electromagnetic fields through said lopped core and within said envelope to excite said discharge-sustaining medium to emit short wavelength radiations, and said layer comprising phosphor is responsive to said short wavelength radiations to emit visible radiations which pass through said envelope.

28. The electrodeless discharge device as specified in claim 27, wherein said passageway means is a single conduit-type passageway extending from one wall portion of said envelope to another wall portion of said envelope.

29. The electrodeless discharge device as specified in claim 28, wherein said single passageway extends through said envelope to provide a relatively constricted spacing between said single passageway and a proximate wall portion of said envelope, and said looped core is conformed to extend through said passageway and to loop about the exterior of said envelope wall portion which is proximate said passageway.

* * * * *